US008177273B2

(12) United States Patent
Santoloci

(10) Patent No.: US 8,177,273 B2
(45) Date of Patent: May 15, 2012

(54) DEVICE FOR BAILING SHALLOW PUDDLES ON FLEXIBLE SHEET SURFACES

(76) Inventor: Frank Santoloci, Sparta, NJ (US)

( * ) Notice: Subject to any disclaimer, the term of this patent is extended or adjusted under 35 U.S.C. 154(b) by 0 days.

(21) Appl. No.: 12/929,454

(22) Filed: Jan. 26, 2011

(65) Prior Publication Data

US 2012/0049554 A1 Mar. 1, 2012

Related U.S. Application Data

(60) Provisional application No. 61/402,388, filed on Aug. 30, 2010.

(51) Int. Cl.
*A47F 13/08* (2006.01)

(52) U.S. Cl. ..... 294/176; 294/181

(58) Field of Classification Search ..... 294/176, 294/180, 1.3, 1.4, 181
See application file for complete search history.

(56) References Cited

U.S. PATENT DOCUMENTS

| | | | | | |
|---|---|---|---|---|---|
| 182,747 | A * | 10/1876 | Button | 294/176 |
| 2,967,729 | A * | 1/1961 | Davis | 294/180 |
| 3,220,037 | A * | 11/1965 | Ruhling | 15/1.7 |
| 3,368,686 | A * | 2/1968 | Petrik | 210/407 |
| 4,247,216 | A * | 1/1981 | Pansini | 403/109.3 |
| 4,616,867 | A * | 10/1986 | O'Hara | 294/180 |
| 5,536,055 | A * | 7/1996 | Kohn | 294/1.3 |
| 5,988,715 | A * | 11/1999 | Mason | 294/181 |
| 6,032,995 | A * | 3/2000 | Barbaro | 294/1.4 |
| 6,058,540 | A * | 5/2000 | Ryall | 15/1.7 |
| 6,209,729 | B1 * | 4/2001 | Brouillard | 210/470 |
| 6,895,672 | B2 * | 5/2005 | Conforti | 30/169 |
| 7,484,859 | B1 * | 2/2009 | Burke | 362/120 |
| 2008/0190838 | A1 * | 8/2008 | Reardon | 210/416.1 |

* cited by examiner

*Primary Examiner* — Saul Rodriguez
*Assistant Examiner* — Gabriela Puig
(74) *Attorney, Agent, or Firm* — Thomas J. Germinario

(57) ABSTRACT

A device for bailing liquid and associated debris from shallow puddles on flexible sheet surfaces comprises a open-ended container, having an oblong transverse cross-section, and a transverse handle, which is attachable to an extension pole.

11 Claims, 12 Drawing Sheets

DEVICE FOR BAILING SHALLOW PUDDLES ON FLEXIBLE SHEET SURFACES

REFERENCE TO RELATED APPLICATION

This application claims the benefit of the filing date of U.S. Provisional Patent Application No. 61/402,388, filed on Aug. 30, 2010.

FIELD OF THE INVENTION

The present invention relates to the field of devices and apparatus used to transfer liquid and/or wet debris from one location to another. More particularly, the present invention relates to portable, manually operated devices for bailing shallow accumulations of standing water and associated debris on non-porous or semi-porous flexible sheet surfaces, such as covers and tarps for protecting structures, vehicles, vessels and/or equipment from the elements.

BACKGROUND OF THE INVENTION

The complete removal of shallow puddles of rain water that frequently accumulate on non-porous and semi-porous covers and tarps is often a difficult task. This task commonly arises in connection with swimming pool covers, boat covers, pickup truck covers, tarps, and other instances in which a non-porous covering is used to protect structures, vehicles, vessels, and/or equipment that are exposed to the elements.

Accumulations of rain water on such non-porous and semi-porous coverings adds weight, which makes it more difficult to remove the covering from the protected structure, vehicle, vessel or equipment. Since puddled rain water also commonly contains debris, such as fallen leaves, dead insects and dirt, the removal of a puddle-laden covering will usually cause dirty water to fall into or upon the protected structure, vehicle, vessel or equipment.

For example, after a rainstorm, water and debris will collect on a swimming pool cover. While a pool cover pump or siphon can remove much of the water, a shallow residual puddle containing saturated debris will always remain. Such residual puddles are unsightly and can contaminate the swimming pool water by leaking through the cover or falling into the pool when the cover is removed.

The problem of extracting shallow accumulations of liquid has been addressed in the prior art by pumping apparatus, an example of which is the U.S. patent application of Reardon (Pub. No. US 2008/0190838). As a pump reaches the bottom of a puddle, however, its inlets tend to become clogged with debris, so that a shallow liquid residual remains. The same short-coming limits the efficacy of siphoning devices, such as the pool cover cleaner taught by the patent to Ryall (U.S. Pat. No. 6,058,540).

The patent to Brouillard (U.S. Pat. No. 6,209,729) discloses a scoop for manually bailing water. But the handle of the Brouillard scoop is in line with the opening of the scoop, so that the scoop must be moved in a shovel-like fashion. While a shoveling movement can be effective in scooping solid materials, such as soil, it is not optimal for liquids, which will tend to flow around the scoop rather than into the scoop opening.

To be effective in bailing very shallow water, a scoop-type device must be designed so that the lower rim of its receptacle opening can reach below the puddle surface, in order that the liquid will flow into the opening of its own accord—"seeking its own level," so to speak. The liquid then can be captured in the receptacle by a slow sideways motion of the scoop, so that the inertia of the fluid tends to carry it into the receptacle opening. A similar lateral movement is employed in connection with netted pool skimmers, such as those described in the patents to Ruhling (U.S. Pat. No. 3,220,037) and Petrik (U.S. Pat. No. 3,368,686). In order to facilitate this lateral motion, the handles on the Ruhling and Petrik skimmers are oriented transversely to the skimmer openings. A similar transverse handle orientation is also taught by Mason (U.S. Pat. No. 5,988,715), as applied to a scoop device for cleaning residential storm drain gutters.

The problem addressed by the Mason patent is different from that of the present invention in one important aspect—in a storm gutter a rigid trough already exists to localize the accumulated water and debris. In the case of a fitted pool, truck or boat cover, on the other hand, the surface is flat, which causes the liquid to spread out. Therefore, an effective bailing device for these applications must be capable of impressing a trough into the otherwise flat surface of the cover or tarp.

SUMMARY OF THE INVENTION

Based on the foregoing discussion, there are several important design criteria applicable to an effective device for bailing shallow puddles water and debris from pool, truck, boat and other similar covers and tarps.

The device should be manually operable by a single person of average strength. This places a limit on the volume of the receptacle and also on the length of the handle and any handle extensions, since the handle/extension will act as a lever arm, multiplying the force needed to lift the weight at its end.

The device should be portable, so that it can be readily moved to different parts of the cover or tarp where liquid has accumulated.

The device should have a means for extending the handle in order to reach all parts of the cover or tarp.

The device should have a handle that is aligned transversely to the opening of the receptacle, so that liquid is captured with a sweeping, sideways movement of the receptacle, rather than a thrusting, shoveling motion.

The opening of the device's receptacle should have an oblong shape in order to maximize the area of the opening that can be submerged in a shallow puddle.

The lower rim of the receptacle opening should have a curvature suited to the tautness of the cover being cleaned. For a very taut pickup truck or boat cover, for example, a flat or nearly flat lower rim would be optimal, since a curved rim would reduce the submersible area of the receptacle. On the other hand, for a somewhat slack swimming pool cover, a convex arcuate lower rim would work best, since the slack in the cover would allow the arcuate rim to form a trough in which the liquid could be localized for easier capture.

Finally, the receptacle should have a substantially uniform transverse cross section, which is to say, it should not be tapered or should be tapered only slightly in either the forward or backward direction. Such a substantially uniform cross-section allows the receptacle to be moved sideways parallel to the surface of the ponded liquid, which maximizes the volume of fluid engaged by the receptacle.

In accordance with the foregoing criteria, the present invention comprises a receptacle container attached to a transverse handle. The handle can be integrally molded to the container, or it can be attached to the container by permanent attachments means, such as rivets. Optionally the handle can be attached to the container by removable attachments means, such as wing nuts, so that variously sized and shaped containers can be interchanged. For example, in cleaning a pool cover, a large rectangular container would be best suited for a puddle close to the side of the pool, where the cover is relatively taut and where the handle can reach without the use of a long extension, which will multiply the force required to lift the filled container. On the other hand, clearing a puddle near the center of the pool, where there is more slack in the cover and where a force-multiplying extension is needed to reach the puddle, a smaller container having an elliptical or truncated elliptical cross-section would be more efficient.

The container has a substantially uniform transverse cross-section, to facilitate a sideways sweeping movement substantially parallel to the surface of the puddle. The cross-section can vary from oblong rectangular with rounded corners, for very taut surfaces, to oblong elliptical or truncated elliptical, for surfaces with some slack, to nearly circular for very slack surfaces. The size of the container can be adjusted based on the leverage of the handle extension being used, with smaller volume and weight being more manageable on the end of a long extension pole.

The handle can be attached to the container so that the longitudinal centerline of the handle is aligned with the major transverse axis of the container (i.e., the axis which bisects the container's transverse cross-section in the direction of its greatest length). This handle configuration, which is illustrated in FIG. 1, is best suited to cleaning surfaces which at waist-level or higher, such as a pickup truck cover. For surfaces at or near ground level, such as a swimming pool cover, the longitudinal centerline of the handle is optimally aligned at an acute angle with respect to the major transverse axis of the container, as shown in FIG. 6. The optimal alignment angle of the handle will be smaller where longer handle extensions are needed, as in cleaning the cover of a very large swimming pool. Optionally, a hinged or pivoting attachment can be used to connect the handle with the container, so that the alignment angle can be varied.

The proximal end of the handle is attachable to one or more types of pole-type extensions, which may have a fixed or adjustable length. The most typical examples of handle extensions are swimming pool vacuum poles and broom/mop handles, as depicted in FIG. 10. Pool vacuum poles commonly use button connectors, of the type disclosed in the patent to Pansini (U.S. Pat. No. 4,247,216) and illustrated in FIG. 11. Broom/mop handles typically have male threaded connections. Preferably, the handle of the present invention has one or more button connections, as shown in FIG. 6, as well as internal female threading, so as to accommodate both vacuum pole and broom-handle type extensions.

DETAILED DESCRIPTION OF THE PREFERRED EMBODIMENTS

Referring to FIGS. 1-12, the present invention is a device 10 for bailing liquid and associated debris from shallow puddles on non-porous or semi-porous, flexible sheet surfaces, such as swimming pool covers, pickup truck covers, boat covers and tarps. The device 10 comprises a container 11, a transverse handle 12, and one or more handle extension (s) 13.

Figure 1:
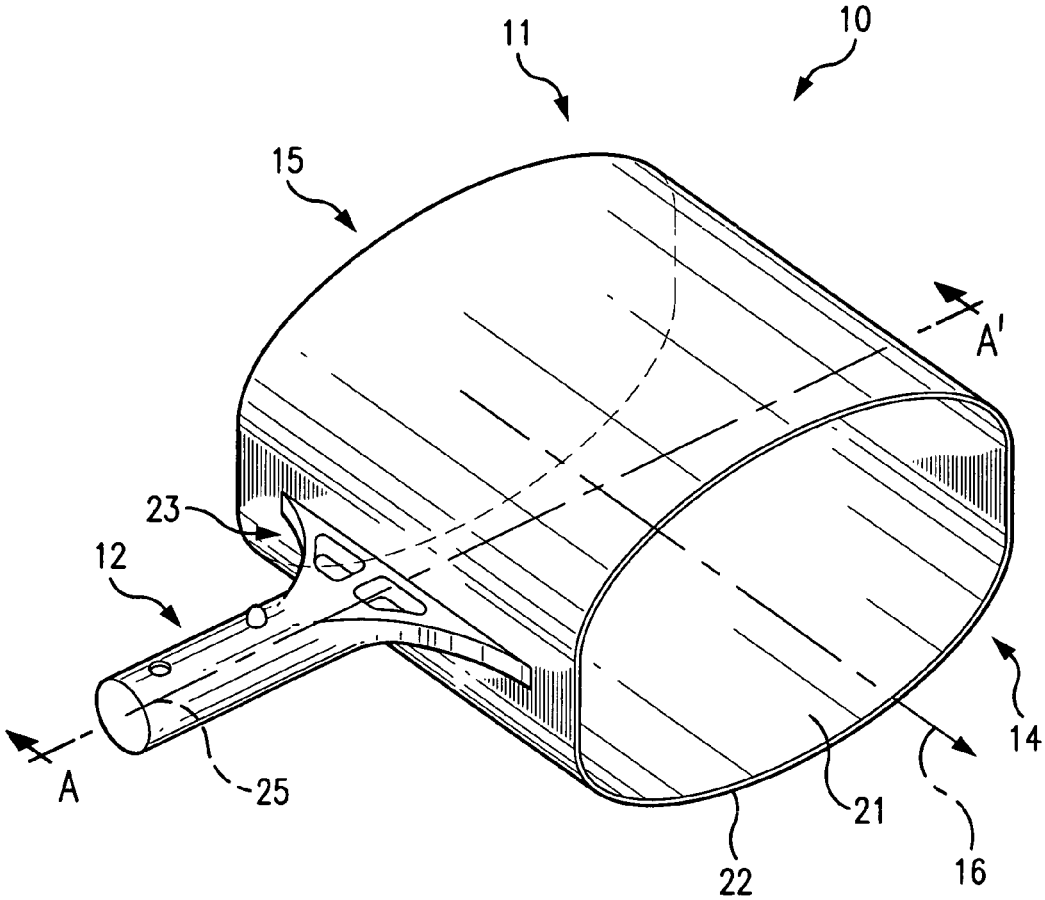
FIG. 1 is an obverse side perspective view of the first preferred embodiment of the present invention.
Figure 2:
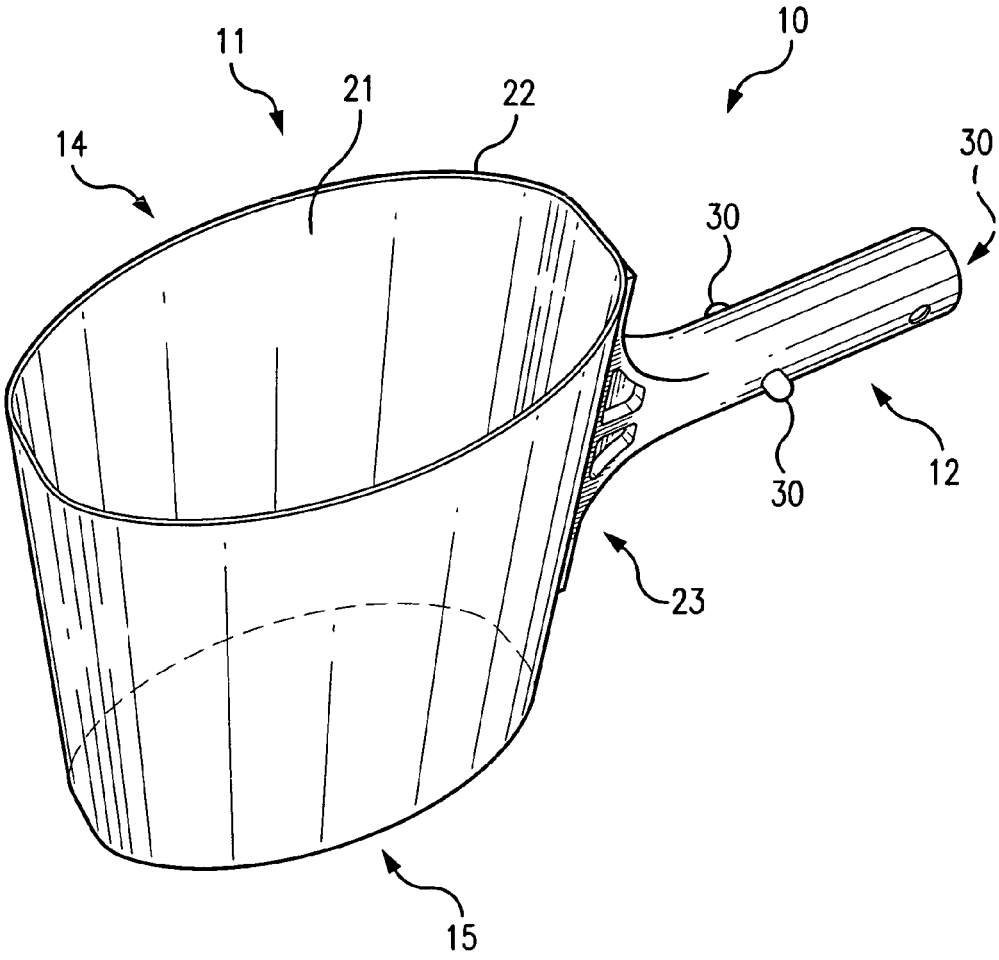
FIG. 2 is an obverse top perspective view of the first preferred embodiment depicted in FIG. 1.
Figure 3:
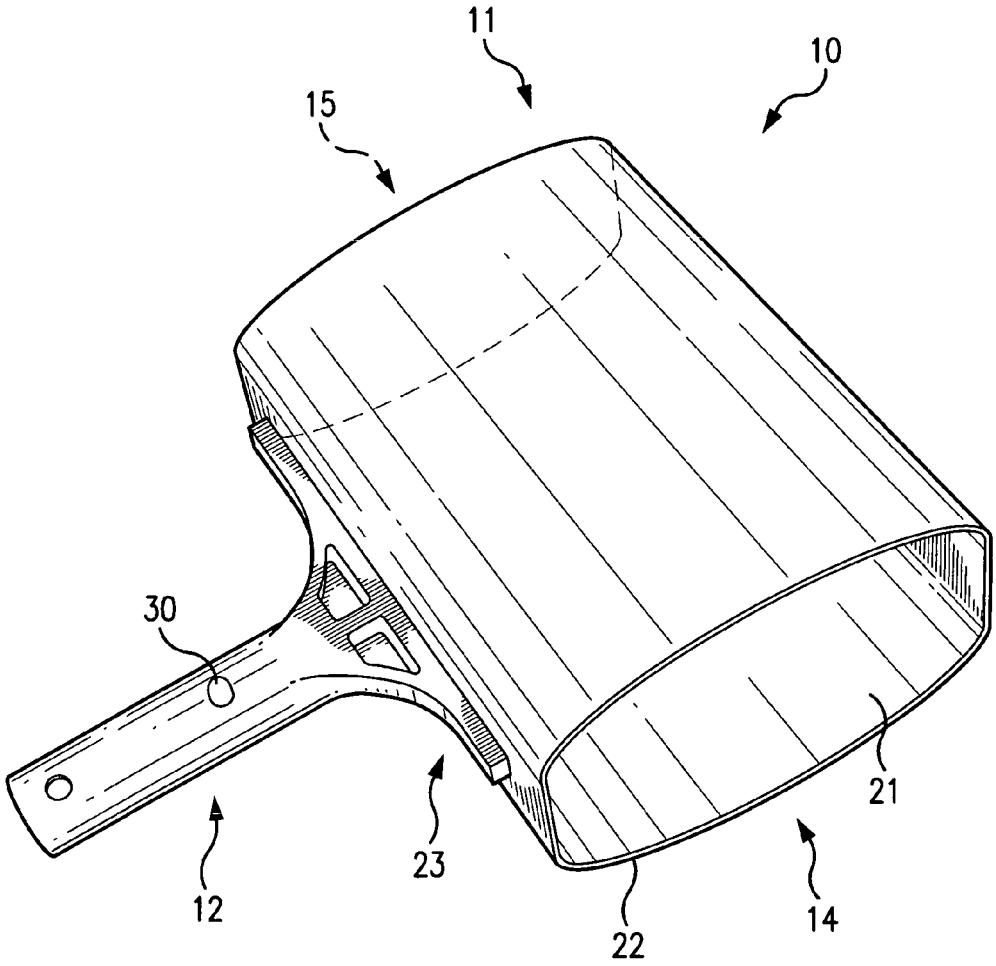
FIG. 3 is an obverse side perspective view of the first preferred embodiment depicted in FIG. 1.
Figure 4:
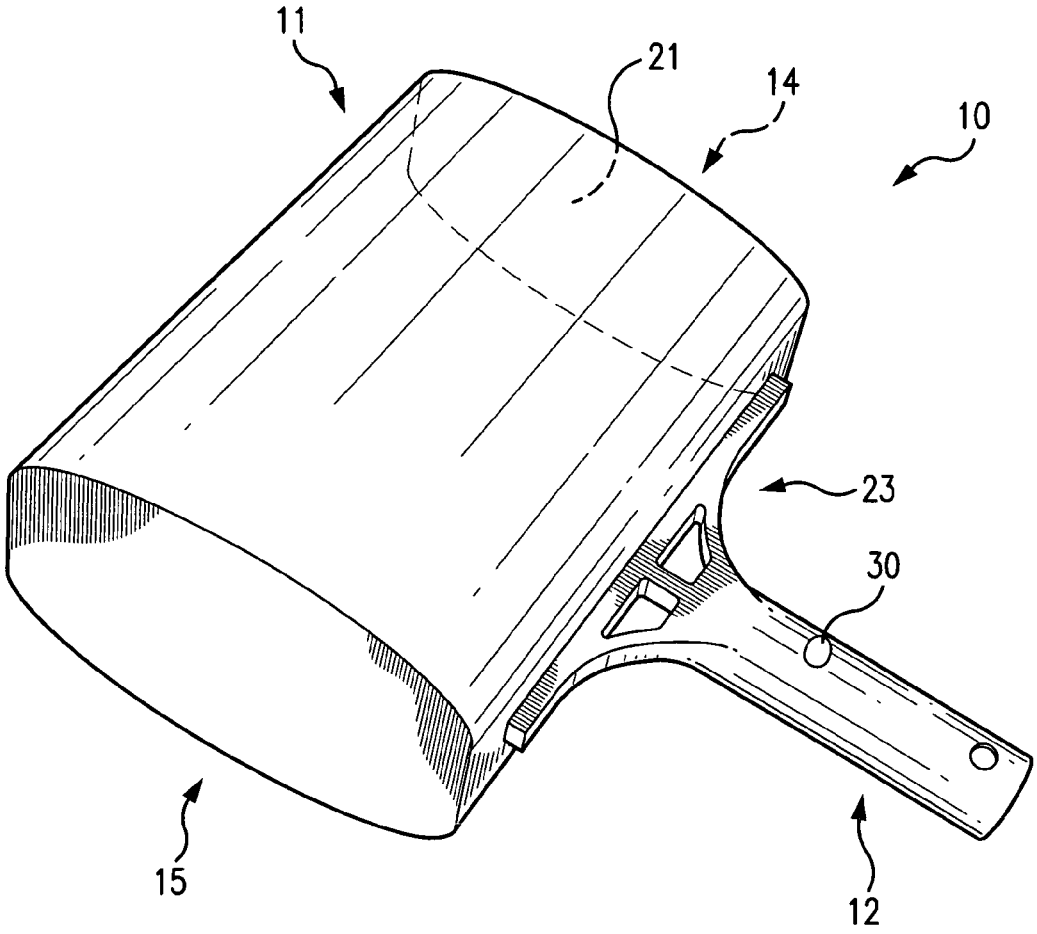
FIG. 4 is an obverse bottom perspective view of the first preferred embodiment depicted in FIG. 1.
Figure 5:
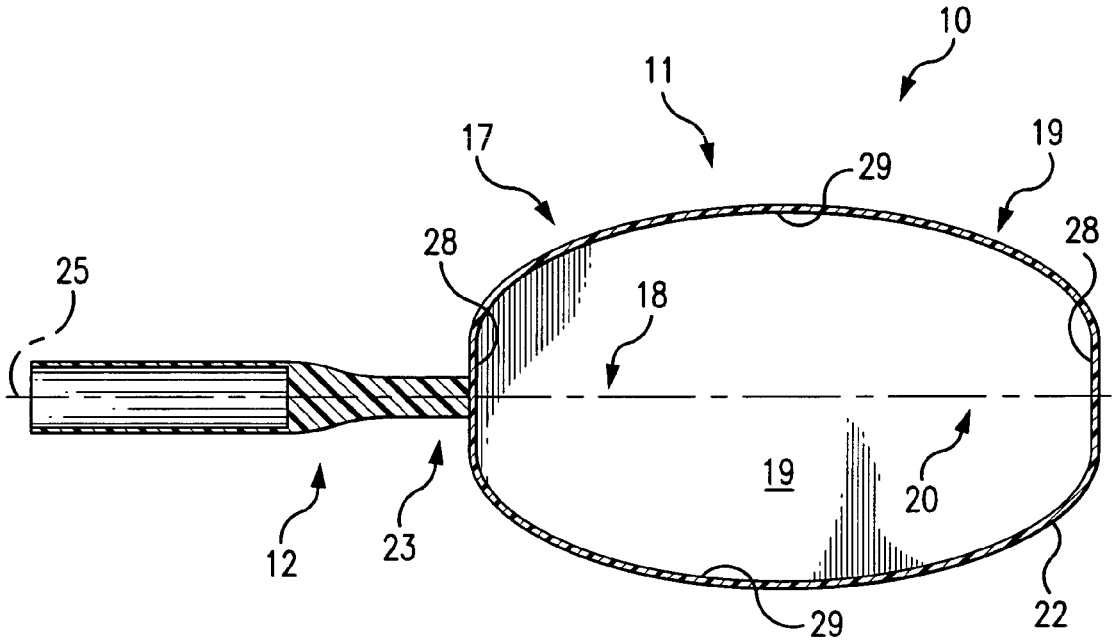
FIG. 5 is a center-transverse cross-section view of the first preferred embodiment along the line A-A' depicted in FIG. 1.
Figure 6:
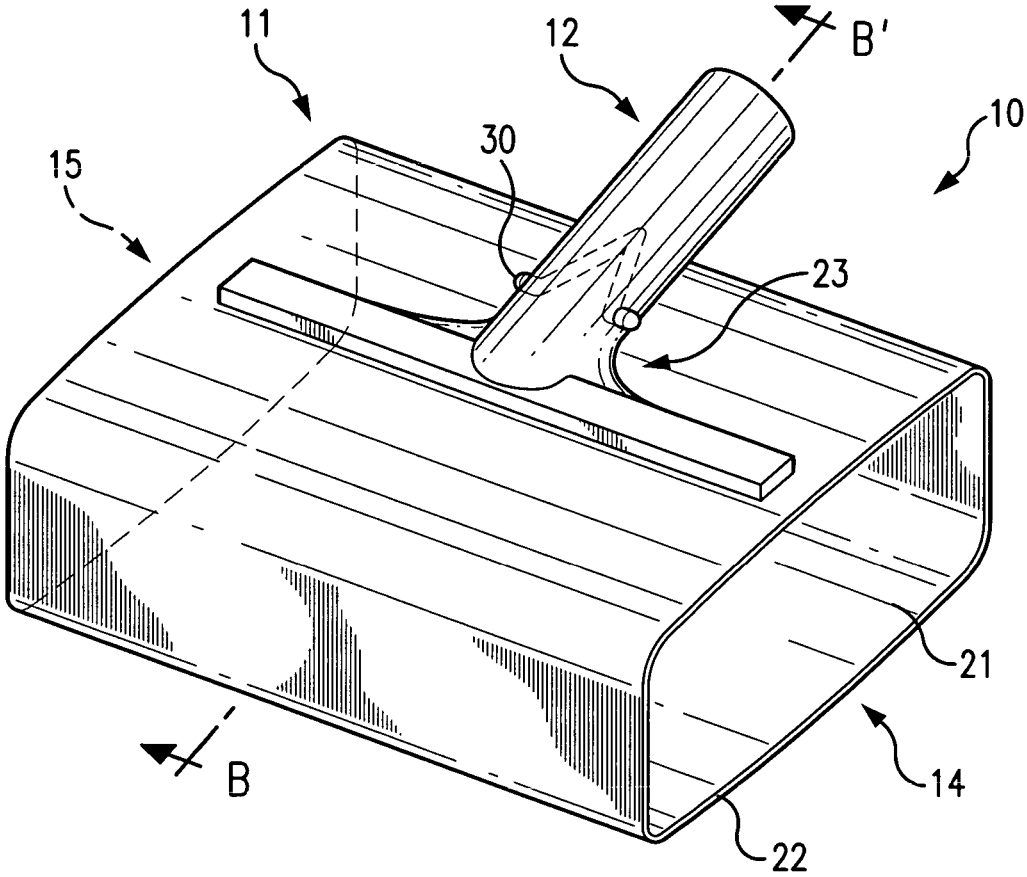
FIG. 6 is an obverse side perspective view of the second preferred embodiment of the present invention.
Figure 7:
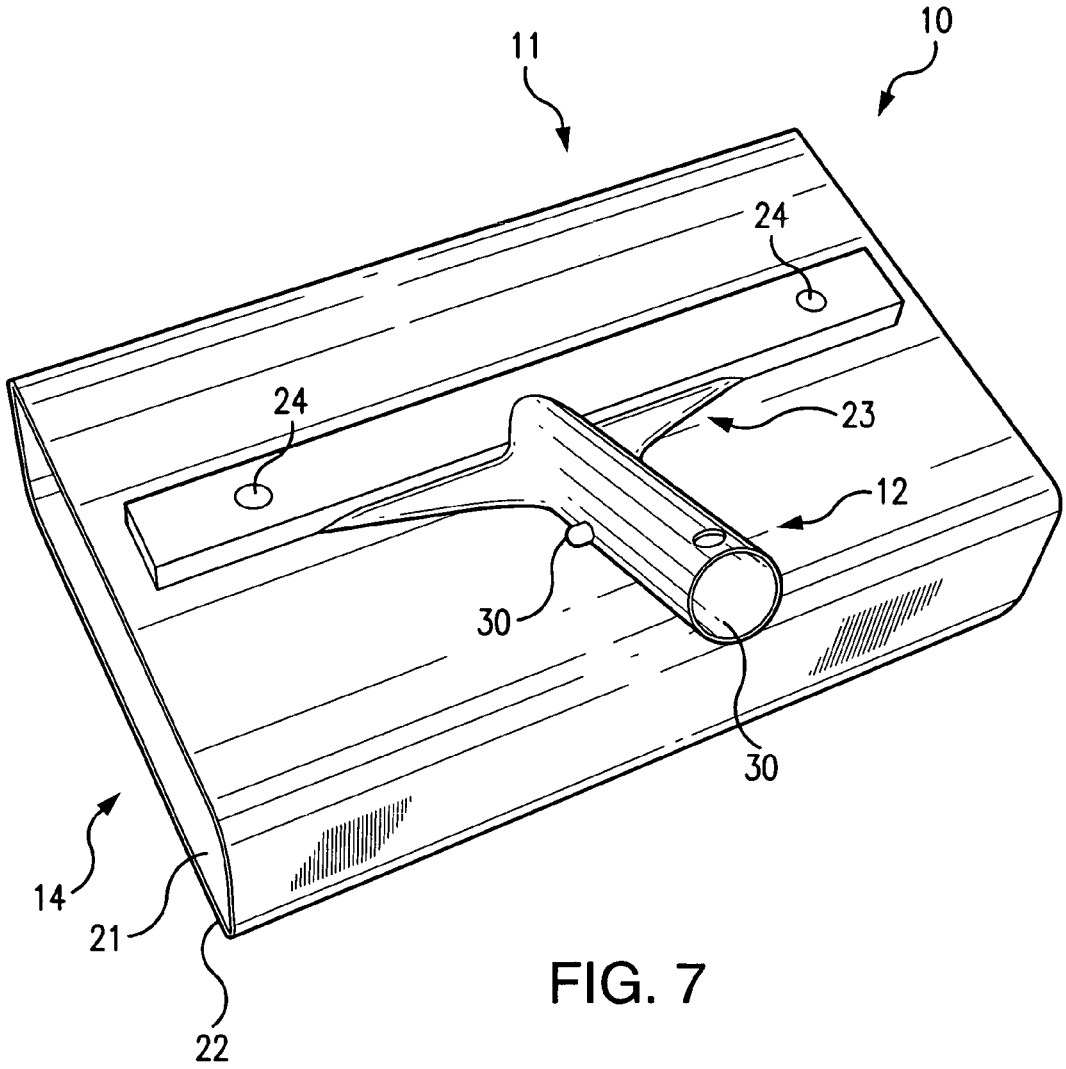
FIG. 7 is another obverse side perspective view of the second preferred embodiment depicted in FIG. 6.

The container has an open top 14 and a closed bottom 15. Extending through the respective centers of the container's top and bottom is a first longitudinal axis 16, as depicted in FIG. 1. Multiple transverse cross-sections 17 of the container 11 lie in planes orthogonal to the first longitudinal axis 16. Each of the transverse cross-sections 17 is substantially uniform with respect to size and shape, so that the container 11 is not tapered or is only slightly tapered either toward the top 14 or the bottom 15. The transverse cross-sections 17 have a uniform oblong shape, and each transverse cross-section 17 has a major transverse axis 18, which bisects the transverse cross-section 17 in the direction of its greater length, as shown in FIG. 5. A central transverse cross-section traverses the midpoint of the first longitudinal axis 16 between the top 14 and bottom 15 of the container 11 and has a central major transverse axis 20, as depicted in FIG. 5.

The container 11 has an opening 21 defined by a peripheral rim 22, which corresponds to the transverse cross-section 17 at the top 14 of the container 11.

The transverse handle 12 is tubular, with a flared distal end 23. The handle's distal end 23 can be integrally molded to the container 11 or connected to the container by one or more handle attachment means 24. The handle attachment means 24 can be permanent, such as screws or rivets, or removable, such as wing nuts. In the latter case, multiple containers 11 of various sizes and shapes can be interchangeable attached to the transverse handle 12, so that a shape and size can be selected that are best suited to the location of the puddle and the tautness of the non-porous or semi-porous surface.

The transverse handle 12 has a second longitudinal axis 25 running lengthwise along the center of the tubular structure, as shown in FIG. 1. The second longitudinal axis of the transverse handle 25 is orthogonal to the first longitudinal axis 16 of the container 11. The second longitudinal axis 25 is oriented at a handle alignment angle $\alpha$ 26 with respect to the central major transverse axis 20 of the container 11, as illustrated in FIG. 8.

Figure 12:
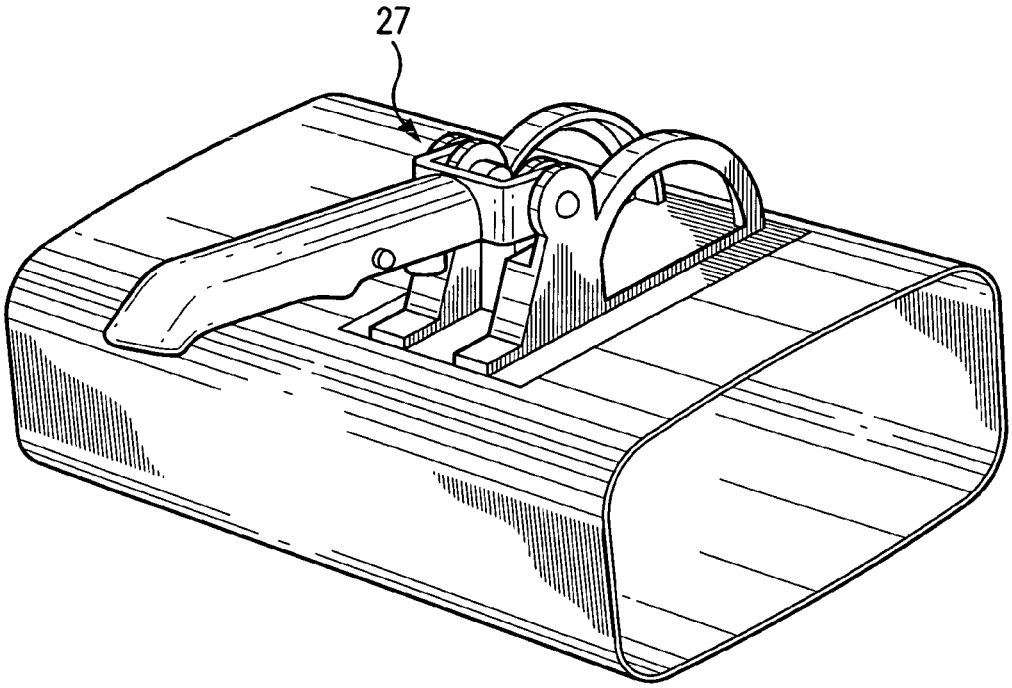
FIG. 12 depicts a pivoting handle attachment for use with present invention.

As explained earlier, the optimal handle alignment angle 26 is determined by the height of the puddle to be cleared from the non-porous or semi-porous surface. In the first preferred embodiment of the present invention, as shown in FIGS. 1-5, the handle alignment angle 26 is zero, while the second preferred embodiment, as depicted in FIGS. 6-9, the handle alignment angle 26 is acute, preferably about 30°. Optionally, the handle alignment angle 26 can be adjustable with the use of a pivoting or hinged handle attachment means 27, as shown in FIG. 12.

Referring to the first preferred embodiment depicted in FIG. 5, each of the oblong transverse cross-sections 17 of the container 11 comprises two flat short sides 28, aligned orthogonally to the major transverse axis 18, and two convex arcuate long sides 29, aligned in the direction of the major transverse axis 18. In order to achieve optimal balance, the second longitudinal axis 25 of the transverse handle 11 is aligned with the central transverse cross-section 19 orthogonally to one of its short sides 28. For reasons explained earlier, the optimal degree of convex curvature of the arcuate long sides 29 becomes greater as the tautness of the non-porous or semi-porous surface decreases.

Figure 8:
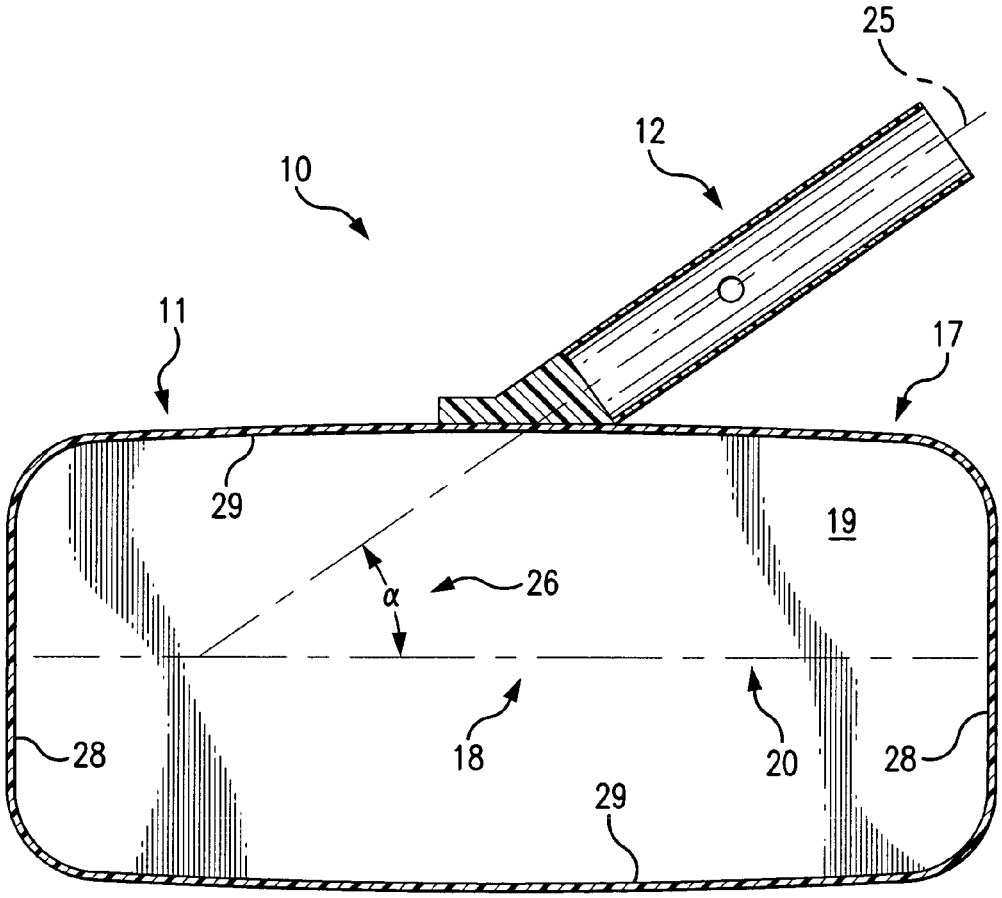
FIG. 8 is a center transverse cross-section view of the second preferred embodiment along the line B-B' depicted in FIG. 6.
Figure 9:
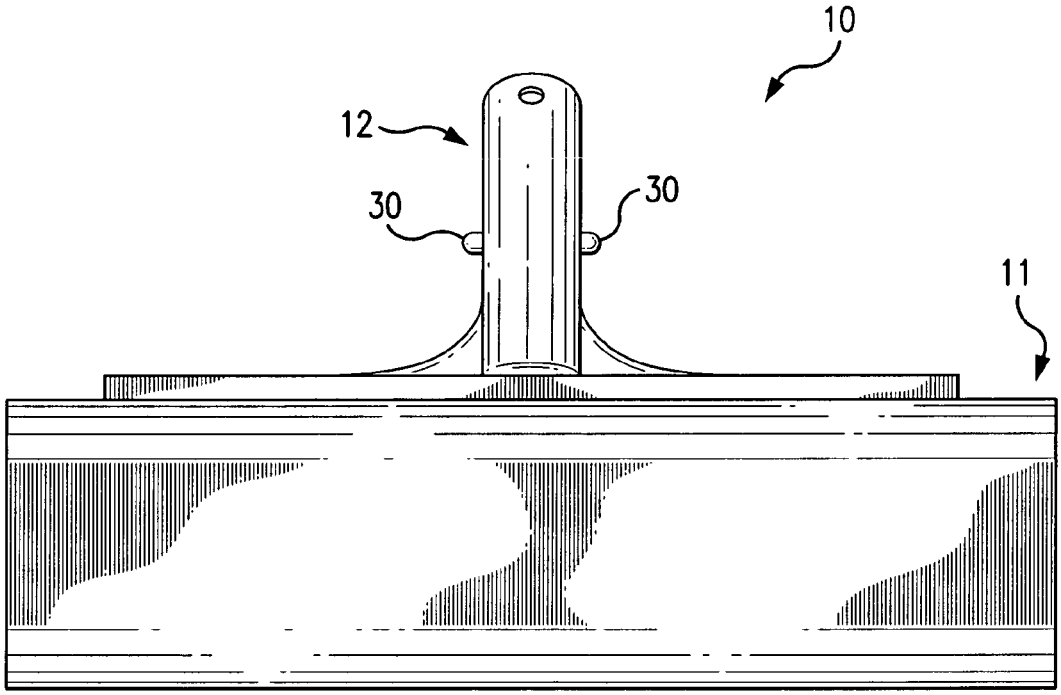
FIG. 9 is a side profile view of the second preferred embodiment depicted in FIG. 6.

Referring to the second preferred embodiment depicted in FIG. 8, the long sides 29 of the oblong transverse cross-sections 17 are flat, thereby providing a container shape optimally suited for use on a very taut non-porous or semi-porous surface.

Figure 10:
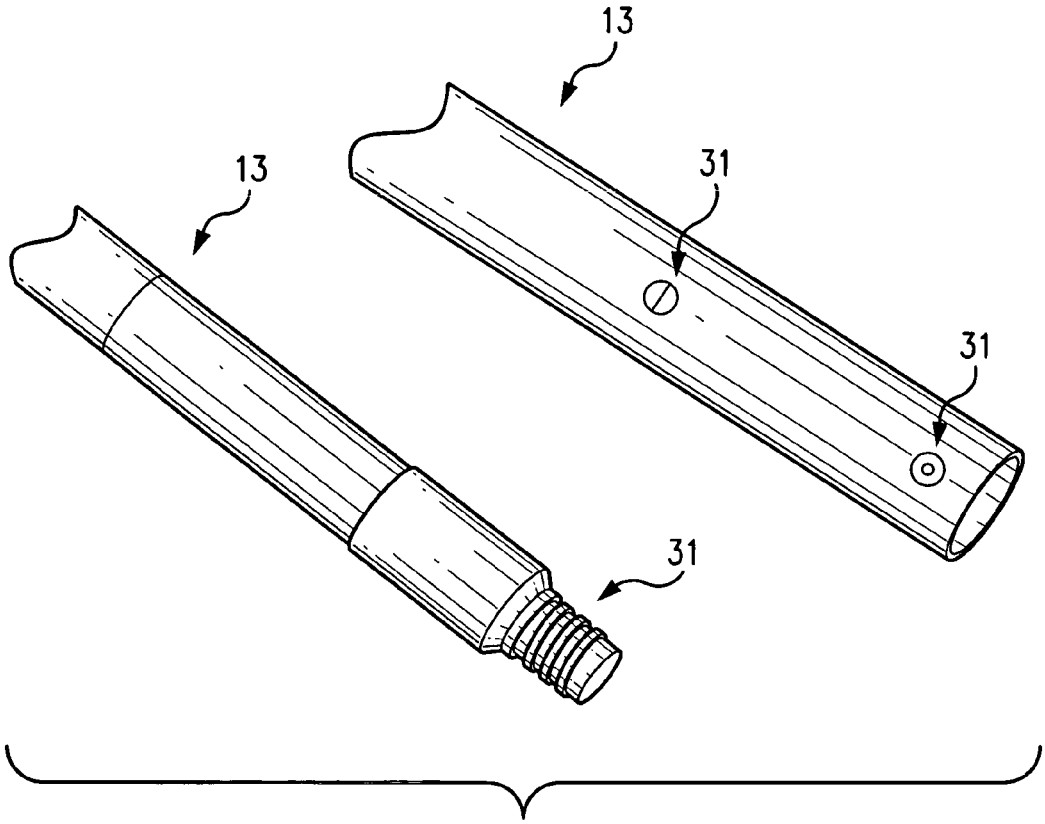
FIG. 10 depicts examples of typical attachment connectors for a standard swimming pool vacuum pole and a standard threaded broom handle.
Figure 11:
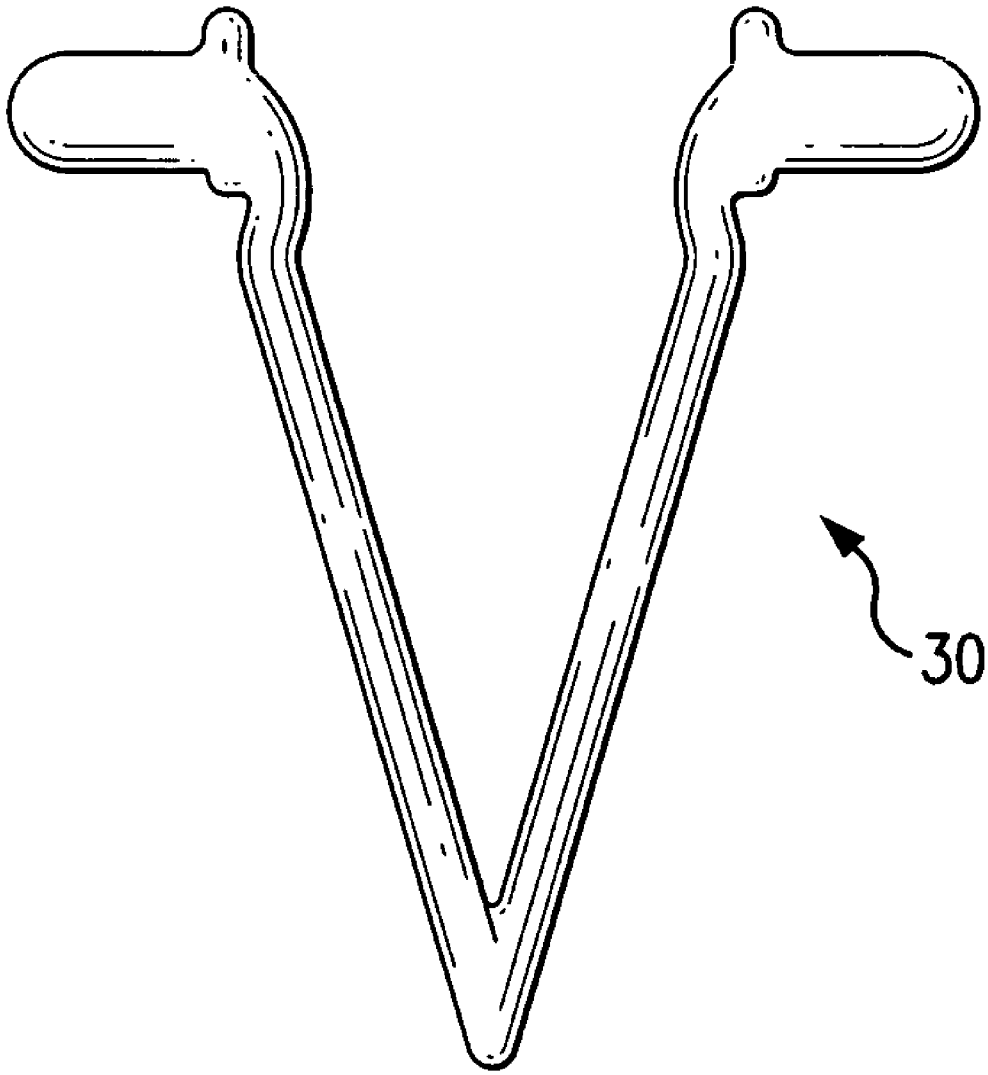
FIG. 11 depicts a standard button connector typically used in swimming pool vacuum poles.

Removably attachable to the proximal end of the transverse handle 12 are one or more interchangeable handle extension (s) 13 of various lengths. Each handle extension 13 comprises a solid or tubular pole, each of which can have a fixed or variable length. One or more first extension attachment means 31 in the transverse handle 12 are used to connect the handle extension 13 to the transverse handle 12. The first attachment means 30 cooperate with one or more second extension attachment means 31 in the handle extension 13. As illustrated in FIGS. 10 and 11, the attachment means 30, 31 can be cooperating male-female treading, in the case of a pole-type handle extension, or button connectors, in the case of a tubular handle extension.

While the present invention has been described for illustrative purposes, those skilled in the art will appreciate that many additions, modifications and substitutions are possible, without departing from the scope and spirit of the present invention as defined by the accompanying claims.

What is claimed is:

1. A device for bailing liquid and associated debris from a shallow puddle on a flexible sheet surface comprising:

a container having an open top and a closed bottom and having a first longitudinal axis extending through the respective centers of the top and bottom, wherein the container has multiple substantially uniform transverse cross-sections, which lie in planes orthogonally aligned with respect to the first longitudinal axis, and wherein each of the transverse cross-sections is oblong and has a major transverse axis which bisects the transverse cross-section in the direction of its greatest length, and wherein a central transverse cross-section traverses the midpoint of the first longitudinal axis between the top and bottom of the container and has a central major transverse axis;

a container opening defined by a peripheral rim, wherein the rim corresponds to the transverse cross-section at the top of the container;

a transverse handle having a proximal end and a flared distal end, wherein the distal end is integrally molded to the container or is connected to the container by one or more handle attachment means, and wherein the transverse handle has a second longitudinal axis, and wherein the second longitudinal axis of the transverse handle is orthogonal to the first longitudinal axis of the container, and wherein the second longitudinal axis lies in the same plane as the central transverse cross-section, and wherein the second longitudinal axis is oriented at a handle alignment angle with respect to the central major transverse axis of the container, and wherein the handle alignment angle is less than 90 degrees, such that the transverse handle extends laterally from the container; and one or more interchangeable handle extension(s) of various or variable length(s), each handle extension comprising a solid or tubular pole that is removably attachable to the proximal end of the transverse handle by one or more first extension attachment means in the transverse handle and one or more cooperating second attachment means in the handle extension(s).

2. The device according to claim 1, wherein each of the oblong transverse cross-sections of the container comprises two short sides, which are aligned orthogonally to the major transverse axis, and two long sides aligned in the direction of the major transverse axis, and wherein the second longitudinal axis of the transverse handle lies in the same plane as the central transverse cross-section , and wherein the transverse handle extends laterally from or toward one of the short sides of the central transverse cross-section.

3. The device according to claim 2, wherein the long sides of the transverse cross-sections of the container have a convex arcuate shape, and wherein the optimal degree of convex curvature of the arcuate long sides is greater in inverse relation to the tautness of the flexible sheet surface from which the liquid and associated debris are to be bailed.

4. The device according to claim 2, wherein the long sides of the transverse cross-sections of the container are flat, thereby providing an optimally shaped container for bailing liquid and associated debris from a very taut flexible sheet surface.

5. The device according to one of claims 2-4, wherein the handle attachment means are removable, and wherein multiple containers having various shapes and sizes can be interchanged by removably attaching the containers to the transverse handle.

6. The device according to claim 5, wherein the handle alignment angle is zero, so that the longitudinal axis of the transverse handle is aligned with the major transverse axis of the central transverse cross-section of the container, and so that the transverse handle extends laterally and orthogonally from one of the short sides of the central transverse cross-section.

7. The device according to claim 5, wherein the handle alignment angle is an acute angle, so that the transverse handle extends laterally and obliquely from one of the long sides of the central transverse cross-section toward one of the short sides of the central transverse cross-section.

8. The device according to claim 5, wherein the handle alignment angle is adjustable with the use of a pivoting or hinged handle attachment means.

9. The device according to any one of claims 2-4, wherein the handle alignment angle is zero, so that the longitudinal axis of the transverse handle is aligned with the central major transverse axis of the container, and so that the transverse handle extends laterally and orthogonally from one of the short sides of the central transverse cross-section.

10. The device according to any one of claims 2-4, wherein the handle alignment angle is an acute angle, so that the transverse handle extends laterally and obliquely from one of the long sides of the central transverse cross-section toward one of the short sides of the central transverse cross-section.

11. The device according to any one of claims 2-4, wherein the handle alignment angle is adjustable with the use of a pivoting or hinged handle attachment means.

* * * * *